US005900562A

United States Patent [19]

Smeding

[11] Patent Number: 5,900,562

[45] Date of Patent: May 4, 1999

[54] WIND INSTRUMENT AND CLOSURE MEMBER FOR WIND INSTRUMENT

[76] Inventor: Rienk Smeding, Commissieweg 30-NL-7957, ND De Wijk, Netherlands

[21] Appl. No.: 08/860,517

[22] PCT Filed: Jan. 12, 1996

[86] PCT No.: PCT/NL96/00027

§ 371 Date: Sep. 11, 1997

§ 102(e) Date: Sep. 11, 1997

[87] PCT Pub. No.: WO96/21923

PCT Pub. Date: Jul. 18, 1996

[30] Foreign Application Priority Data

| | | | |
|---|---|---|---|
| Jan. 13, 1995 | [NL] | Netherlands | 9500076 |
| Mar. 31, 1995 | [BE] | Belgium | 09500298 |
| Aug. 4, 1995 | [BE] | Belgium | 09500678 |
| Dec. 15, 1995 | [BE] | Belgium | 09501039 |

[51] Int. Cl.[6] ..... G10D 7/08

[52] U.S. Cl. ..... 84/385 P; 84/380 R

[58] Field of Search ..... 84/388, 385 P, 84/385 R, 380 R

[56] References Cited

U.S. PATENT DOCUMENTS

| | | | |
|---|---|---|---|
| 1,401,872 | 12/1921 | Buescher | 84/385 P |
| 2,534,660 | 12/1950 | Collis | 74/385 P |
| 3,205,752 | 9/1965 | Carruthers | 84/380 R |
| 3,501,991 | 3/1970 | Carruthers et al. | 84/380 R |
| 4,704,939 | 11/1987 | Straubinger | 84/385 P |
| 4,729,275 | 3/1988 | Elbaz | 84/385 P |

FOREIGN PATENT DOCUMENTS

| | | |
|---|---|---|
| 0240426 | 10/1987 | European Pat. Off. . |
| 1034063 | 7/1953 | France . |
| 2685972 | 7/1993 | France . |
| 1903244 | 9/1969 | Germany . |
| 8805359 | 7/1988 | Germany . |
| 717902 | 11/1954 | United Kingdom . |
| 8809987 | 12/1988 | WIPO . |

*Primary Examiner*—William M. Shoop, Jr.
*Assistant Examiner*—Shih-yung Hsieh
*Attorney, Agent, or Firm*—Webb Ziesenheim Bruening Logsdon Orkin & Hanson, P.C.

[57] ABSTRACT

A wind instrument is provided having a basic body in which extends a central duct which is bounded by a peripheral wall of the basic body, a plurality of openings in the peripheral wall which connect the duct with the surrounding air, a plurality of valves mounted on the basic body and each having a closure member co-acting with an opening and having a control assembly connected to the valves. The control assembly guides the closure member for movement between a closed position in which the opening is closed by the closure assembly and an open position in which the opening is left clear. The closure assembly has a plate of stiff material which is provided on the side facing toward the opening with sealing material and which in the closed position engages sealingly around the opening. The closure member is connected to the control assembly by a yieldable member.

58 Claims, 11 Drawing Sheets

25
8
5B
12B
43
12A
5A
15B
15A
2
21B
21A
42A
38
41A
6

21
5
8
44
45
25
39
S
15
18
16

21
5
32
44
IX
8
46
45
47
18
16
48
39
15

WIND INSTRUMENT AND CLOSURE MEMBER FOR WIND INSTRUMENT

BACKGROUND OF THE INVENTION

The invention relates to a wind instrument, such as a saxophone, clarinet, flute, bassoon, oboe or instrument provided with closure members.

Such a wind instrument comprises a basic body in which extends at least one central duct which is bounded by a peripheral wall of the basic body. Formed in the peripheral wall is a number of holes which connect duct with the surrounding air. At least a number of these openings can be opened and closed by means of closure members mounted on the instrument. Particularly the pitch which is produce is determined by the open or closed position of the closure members during playing of the instrument, wherein generally the higher the position of the closure member which is opened, the higher the pitch obtained.

In known wind instruments of this type the closure members comprise in each case a cup-shaped holder which forms part of the control means and wherein a closure pad is fixed, for instance with sealing wax. This closure pad constitutes the closure member which can close and leave clear the associated opening in the peripheral wall. According to the prior art the closure pad is for instance composed of a felt cushion bounded by leather. In some cases a basic layer of cardboard is also used as well as a thin plate of metal or plastic riveted thereto.

For good operation of the wind instrument it is essential that the closure members do indeed close properly in the closed position. Even in the case of a minor leakage the desired tone or tones cannot be produced, or in any case not properly. Accurate arrangement of the closure members is therefore of great importance. This is particularly the case when a plurality of closure members is closed simultaneously with common control means.

The closure pads must be replaced regularly due to wear and/or deforming thereof. This is a time-consuming and costly process. The closure pads are usually secured in the cup-shaped holders with sealing wax and, when a complete engagement in the closed position is not already obtained initially, a precise adjustment of the closure pads is subsequently obtained by arranging small fillings, for instance of paper or cardboard, behind the cushions so that the closure members seal properly over the whole periphery and/or so that the simultaneously closing closure members are completely sealed.

The invention has for its object to provide a wind instrument of the type stated in the preamble wherein said drawbacks of known instruments occur to a lesser degree.

SUMMARY OF THE INVENTION

According to the invention this is achieved by applying the characterizing feature of claim 1. Due to the plate of stiff material the closure member will automatically make a good engagement on the whole periphery of the opening when it is pressed against the opening. Due to this engaging position of the closure member coupled to the control means, the correct position of the closure member relative to the opening is achieved at once. Due to the yieldable means the closing stroke and the height of lift of the closure member of the one opening can adapt yieldably, i.e. automatically, to the closing stroke respectively height of lift of the closure member of another opening, said two openings being controlled simultaneously by means of common control means.

This prevents the one closure member leaking when the other closure member which is coupled thereto is already closed. By applying this inventive step the mutual adjustment of these mutually coupled closure member no longer requires an extremely precise adjustment. Replacement of closure members hereby becomes very simple. Adjustment operations are no longer necessary, or hardly so. The control mechanism is subjected to a lesser degree of wear and the stop corks of the control mechanism are trapped less frequently, resulting in a longer lifespan.

Particularly in a known saxophone wherein the closure members can have very large dimensions, the closure pad has a marked influence on the sound in that it functions as a muffing area. Particularly the high harmonic sounds in the produced tone are rapidly muffled hereby. It has been found that in the wind instrument according to claim 2 the sound is considerably improved and in particular comprises more of the higher harmonic tones. By using the hard, preferably metal, plate material which remains substantially uncovered, the above stated muffling is avoided.

The closure members increase the amount of material, the weight and the production activity involved in making wind instruments. The invention provides a wind instrument according to claim 3 which requires less material, has a lower weight and is easier to manufacture.

A suitable embodiment is further characterized in claim 4. The foam material can effect precisely the required yieldability of the connection, over a small height.

A further developed wind instrument is characterized according to claim 5. The closure members are herein connected to control rods by means of a simple support member allowing a tilting movement.

By applying the step of claim 6, a couple sufficient to center the closure member or on the opening is realized with a small closure force. Moreover, the closure member is then free on both its sides and therefore muffled less.

The invention also relates to and provides a closure member according to any of the claims 8–10.

BRIEF DESCRIPTION OF THE DRAWINGS

The invention will be further elucidated in the following description with reference to the accompanying drawings, wherein.

In the figure description functionally identical elements have the same numerals.

DESCRIPTION OF THE PREFERRED EMBODIMENTS

Figure 1:
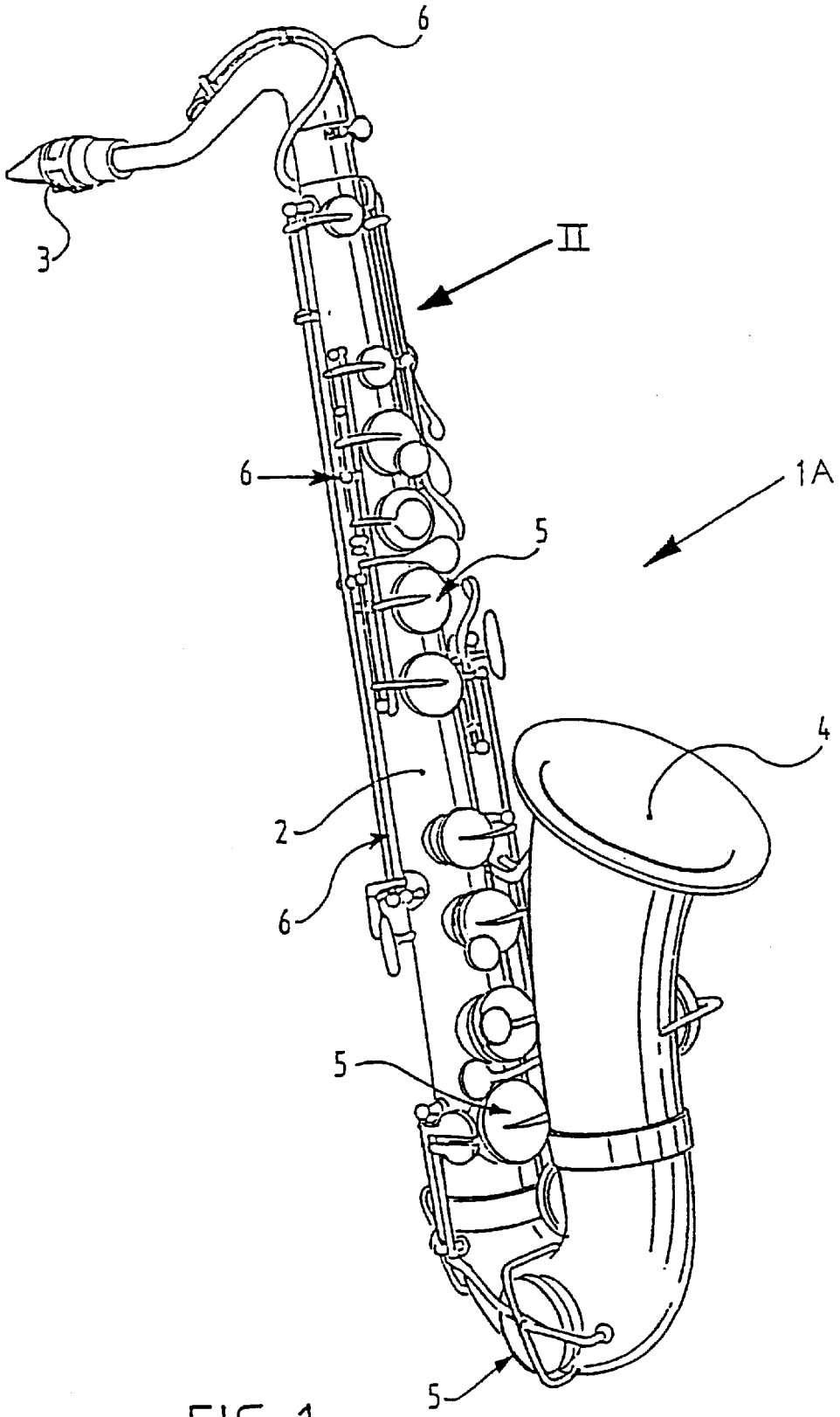
FIG. 1 shows a perspective view of a saxophone, being a wind instrument according to the invention.

The saxophone 1 shown in FIG. 1 comprises a basic body or hull 2 of metal, for instance brass, through which extends a duct. A hull of wood, hard plastic or compound material, such as ground hardwood with epoxy resin, is also possible in particular instruments.

This duct extends from the mouthpiece 3 to the front opening 4*a* on front end of basic body 2. When the saxophone 1 is played the column of air in the duct is brought into resonance. The resonance frequency and thus the pitch produced depends on the length of the resonating air column.

In the peripheral wall of basic body 2 is formed a plurality of openings which can be closed or opened by valves 5. The length of the resonance column is generally determined by the valve opened closest to the mouthpiece 3.

The valves 5 comprise closure members which are movable by control means 6 between an opened position at a distance from the associated opening 4 and a closed position wherein the opening 4 is closed by the closure member 15. The valves 5 are controlled by hand in order to create a desired pitch.

Figure 2:
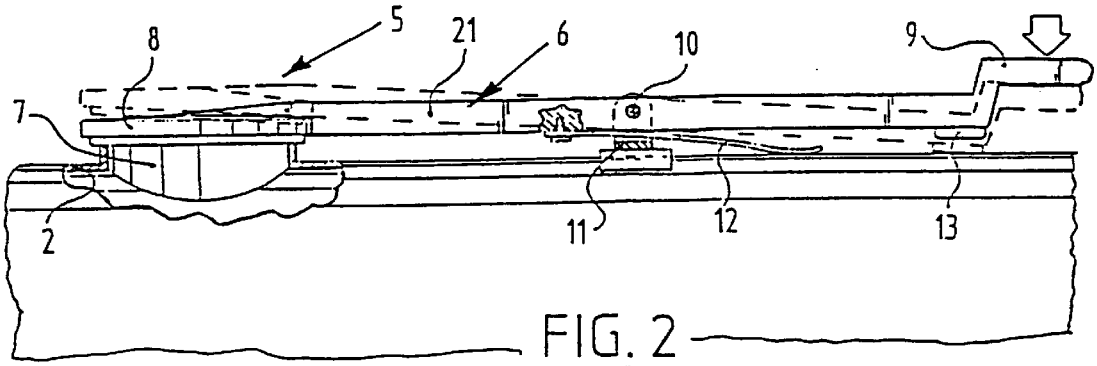
FIG. 2 shows a detailed view of a closure member of the saxophone of FIG. 1 as according to arrow II.

FIG. 2 shows the principle of a valve 5 of the saxophone 1. In this embodiment the valve 5 comprises a cup-shaped cover 8 receiving a closure member 15 to be describes further. The cover 8 is connected to a rod 21 which is pivotally connected at 10 to a support 11 fixedly connected to basic body 2. On the opposite end the rod 21 is provided with a key 9. On rod 21 is arranged a leaf spring 12 which, in this example, urges rod 21 in counter-clockwise direction, i.e. urges the cover 8 onto opening 4. The cover 8 with closure member 15 received therein can thus be moved away from opening 4 by pressing the key 9. The opened position of valve 5 is determined by a stop element 13 which is usually made of cork.

Figure 3:
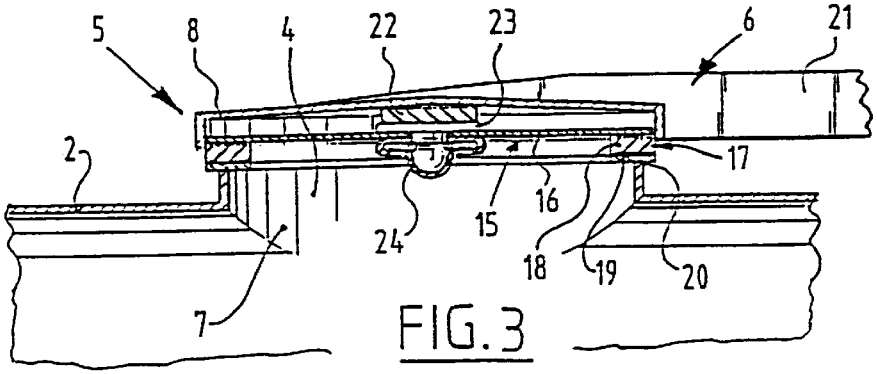
FIG. 3 shows a cross-section of the closure member of FIG. 2 at the position of the opening.

FIG. 3 shows the embodiment of the valve 5 at the position of the opening 4. The actual closure member 15 comprises a substantially stiff plate 16, in any case a plate of hard material, which is provided with sealing material 17 on the side facing toward the opening 4. In this embodiment the sealing material consists of a ring 18 either of foam material, such as a thin layer of cellular rubber with a thickness in the order of magnitude of 0.5 to 2 mm, preferably between 0.5 and 1.5 mm and in particular between 0.7 and 1.2 mm, which layer is optionally covered with a thin layer of supple leather 19, or of very soft solid rubber which is for instance vulcanized to the plate 16, said ring being connected directly to the stiff plate 16. The edge 20 around the opening 4 is usually made flat so that the surface of the sealing material can make good sealing engagement on this edge. The leather layer 19 is preferably not used and the thin layer cellular rubber consists of cellular rubber with very small closed cells. The average cell diameter is smaller than 0.5 mm, for instance smaller than 0.3 mm and preferably smaller than 0.2 mm. This sealing material is for instance coated on the outside with a sealing film to prevent infiltration of moisture. In small valves, for instance of a clarinet, the said ring 18 is for instance replaced by a round disc of the same material.

The hard plate 16 is preferably a metal plate made flat so that it extends accurately at a constant distance from the edge 20 and the sealing surface is thus supported accurately in one and the same surface. The plate 16 has a rigidity, depending on the selected metal type and the diameter of the tone opening, such that the deflection of the plate resulting from strong playing force (approximately 2N) is preferably smaller than 0.3 mm, more preferably smaller than 0.2 mm, for instance in the order of magnitude of 0.1 mm. In the case of stainless steel (stainless steel 430) the plate thicknesses are 0.1 to 1 mm, preferably 0.15–0.8 mm, most preferably in the order of magnitude of 0.5 mm.

Figure 6:
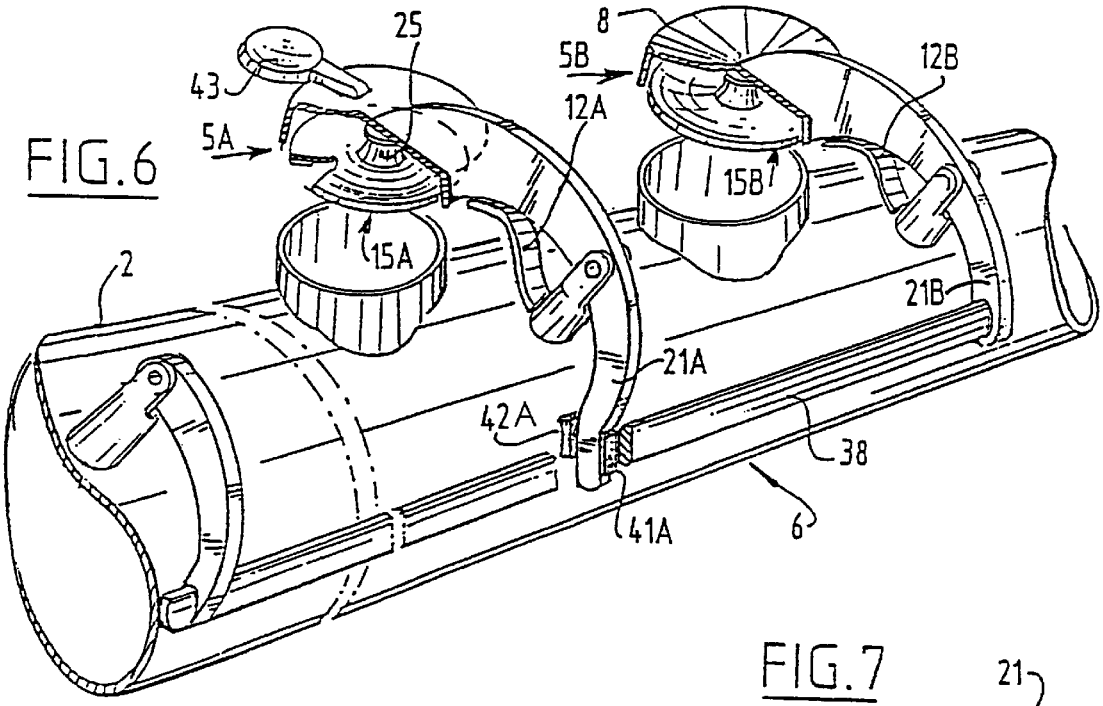
FIG. 6 is a perspective view of a fraction of an instrument according to the invention.

In the shown preferred embodiment the closure member 15 is yieldably connected to the control means 6. This yieldable connection is realized in that a male part 123 of a hard rubber press fastener is glued into the cover 8 with interposing of a foam resin pad 22, preferably with a thickness in the order of magnitude of 2 mm. The stiff plate 15 is pushed over this male part 23 of the press fastener and the female part 24 (of hard rubber or plastic) of the press fastener is subsequently snapped onto the part protruding through the plate 16. The foam material 22 constitutes yieldable means with which the closure member 15 is connected for slight movement to the control means 6. In terms of its position, the closure member 15 and particularly the sealing ring thereof can adapt precisely to the edge 20 and make all-round close sealing engagement therewith, even if in the not yet fully closed position the closure member 15 were to lie in slightly inclining position relative to the edge 20. Due to the pressure force of the spring 12 or, in the opposite case, due to the pressure force exerted by hand, the closure member 15 comes to lie precisely on the edge 20. Due to these yieldable means in the form of the layer of foam material 22, the valves 5, mutually connected for instance as according to FIG. 6, are easily adjustable relative to each other. With little adjustability the simultaneous good closure can be realized with little pressure force. In FIG. 6 for instance the valve 5B is also closed each time that each or any of a series of valves 5A is closed. For this purpose the rod (21B which is urged to the open position by a spring 12B is fixedly connected to a longitudinal rod 38, which supports via a cork 41A on the rods 21A which themselves support in the open valve position on the body 2 via a cork 42A. If at least one of the valves 5A is closed by means of the finger key 43 soldered thereon, the closure members 15B and 15A will simultaneously close properly, because both closure members 15B and 15A are connected to control means 6 via the yieldable means. It is also conceivable that a valve 5B can be closed either individually and directly by means of its own finger key (not drawn), or together with one or more other valves 5A by means or longitudinal rod 38.

Figure 4:
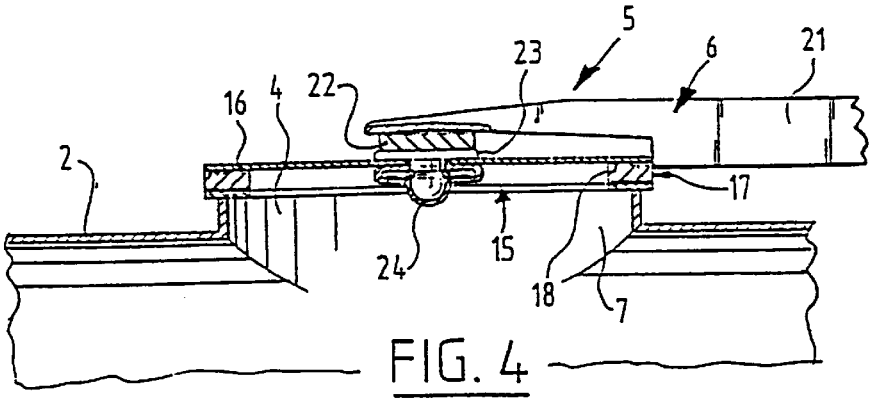
FIG. 4, 5, 7–13, 15, 17–19, 21 and 23–28 each show a view corresponding with FIG. 3, in each case of a different embodiment.

FIG. 4 shows a slightly modified embodiment. The cover 8 is herein omitted and the closure member 15 is directly connected to the rod 21 of control means 6 using the above described press fastener connection. The mass of the control means 6 hereby becomes smaller, which can contribute to a lighter operation of the valve mechanism.

Figure 5:
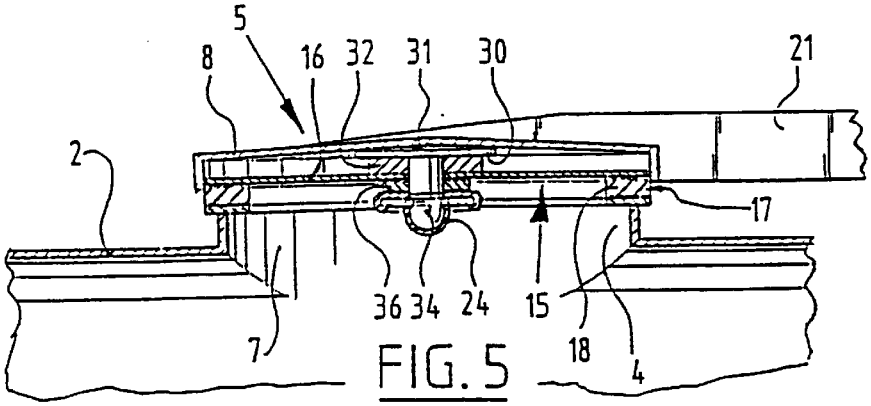

In the embodiment of FIG. 5 a snap connection by means of a press fastener is likewise used. The male part 30 of the press fastener is arranged fixedly in the cover 8 by means of a glue or cement connection 31. A ring 32 of yieldable material, in particular foam material, is first arranged over the protruding portion 34 of the male press fastener part 30, whereafter the metal closure plate 15, a second ring 36 of yieldable material and the female part 24 of the press fastener are successively arranged. For a permanent connection the press fastener part 30 can for instance also be soldered to the rod 21 of the control means 6.

As can be clearly seen in the FIG. 3–5, by far the greater part of the opening 4 is closed by the uncovered surface of the stiff metal, for instance brass plate 16, which has on neither of its sides any centrally located engaging material causing muffling. Little or no muffling hereby occurs at the position of the closed opening 4, whereby the sound of wind instrument 1 becomes fuller and more brilliant than is achieved with the usual closure pads.

Fitting of the stiff plates 16 is very simple. Hardly any or no adjusting operations are required to ensure that the sealing material 18 engages the whole periphery of the opening 4.

It has been found that the tuning of the instrument, which is also determined by the distance of the closure members 15 to the opening 4 in the opened position, can be controlled better. The mechanism is found in practice to be a little faster and the sticking (running on) of valves does not occur or does so to a lesser degree.

The invention is not limited to the preferred embodiments shown in the figures. Even without the yieldable connection of the closure member 15 with the control means 6 the advantage is already achieved of simpler mounting of the closure plates with less adjustment work and/or a better sound of the instrument.

Assembly of the closure members 15 using the snap connection, particularly formed by a press fastener, enables a very simple replacement of the closure member 15. However, it falls within the scope of the invention to fix the closure members 15 to the control means respectively in the cover 8 with for instance a piece of double-sided foam adhesive tape.

Figure 8:
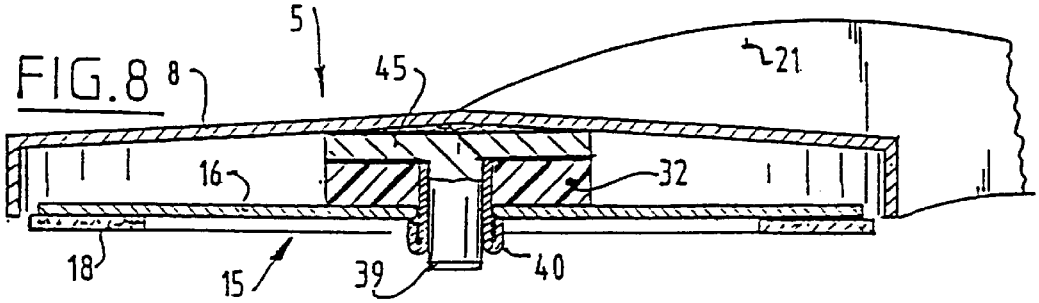
Figure 9A:
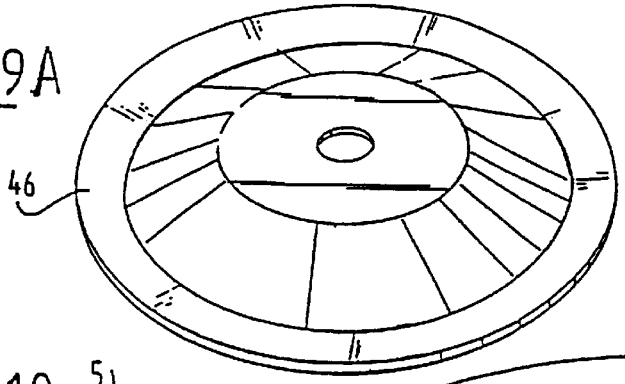
FIG. 9A is a perspective view of detail IX of FIG. 9.

According to FIG. 8 a smooth pin 39 is fixed to the control means 6, for instance by soldering. The ring 32 and the closure member 15 are placed on the pin 39 and held thereon by means of an element, for instance a piece of folded rubber hose 40, which clamps on the protruding end of the pin 39.

In FIG. 6 the closure member 15A, 15B is fixed to a cover 8 by a base plate 45 of a pin 39 being soldered to the cover 8 and a rubber block 25 being placed over this pin 39 and glued to base plate 25 and stiff plate 16. The plate 16 is centered by the pin 39 and can move slightly axially as well as tilt relative to the cover 8. Rough mutual valve adjustment takes place by slight bending of brass rods 21 or of other control elements of the control means 6.

Figure 7:
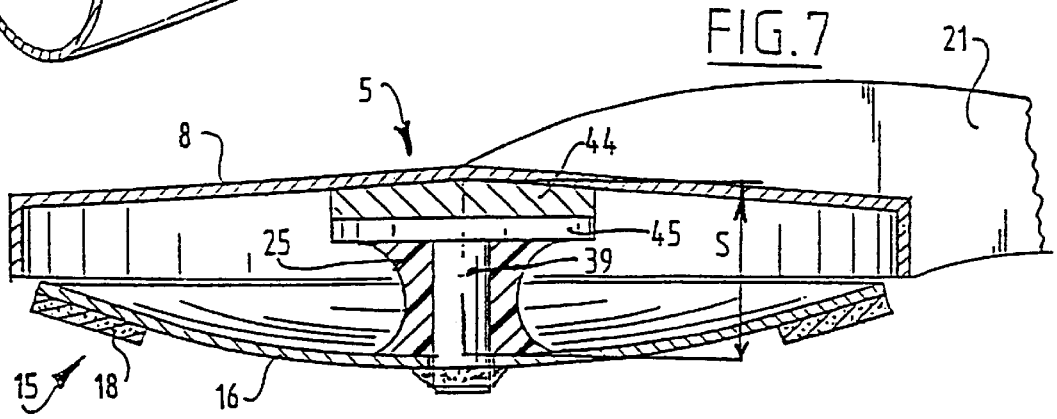

The valve 5 of FIG. 7 is the same as that of FIG. 6, with the modification that a filling 44 is arranged between cover 8 and base plate 45 of a hard rubber pin, so that universal rubber blocks 25 can be employed for diverse distances s at different valve dimensions.

Figure 9:
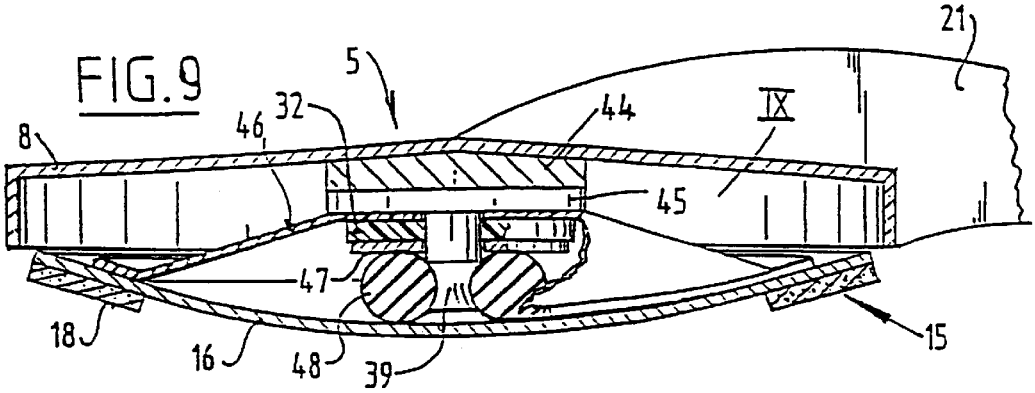

The valve 5 of FIG. 9 comprises a cover 8 which is welded to a rod 21 and in which a base plate 45 of a pin 39 is rigidly connected via a filling 44. A flexible, substantially non-stretchable, thin membrane 46 first adhered to a ring 32 of elastic material, for instance 0.5 to 1 mm cellular rubber. Placed thereon is a stiff pressure ring 47 and on the latter a small, practically solid perforated rubber block 48, for instance a ring with a thickness of 0.5–1 mm, which are all placed onto the pin 39 above the stiff plate 16. The peripheral edge of the membrane 46 is subsequently glued in stretched position to the stiff plate 16. The base plate 45 is then rigidly glued to the cover 8 via filling 44. The stiff plate 16 can swivel slightly about the ring 48 and can displace slightly in axial direction due to the yieldable layer 32. The sealing ring 18 of cellular rubber may therefore be thin, for instance 1 to 2 mm.

Figure 10:
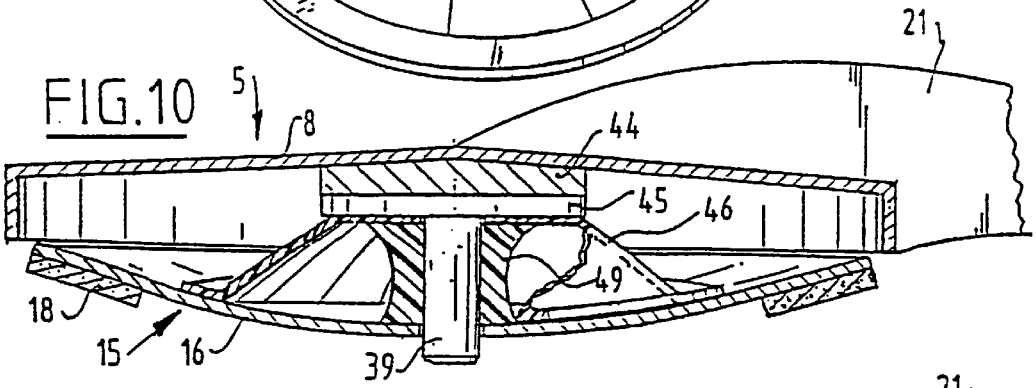

The valve 5 of FIG. 10 has said membrane 46 and the rubber block 49 which replaces the ring 32. The elasticity of the rubber block 49 is in the order of magnitude of 0–70° Shore, preferably 30–50° Shore, i.e. chosen such that the required yield of 0.25 to 0.5 mm is automatically obtained with finger force actuation of the keys to ensure the closed position of mutually coupled valves 5. The block 49 is glued to the stiff plate 16 and base plate 45. The membrane 46 is glued to the base plate 45 and stiff plate 16. The membrane 46 of FIGS. 9 and 10 has in reality a slight inclination.

Figure 11:
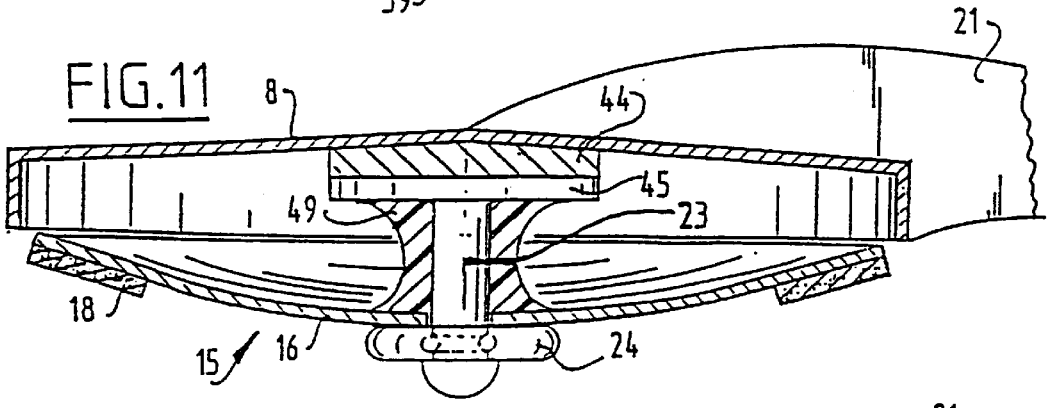

In contrast to FIG. 10 the centering membrane 46 is replaced in FIG. 11 by the centering press fastener 23, 24 of hard rubber or plastic.

Figure 12:
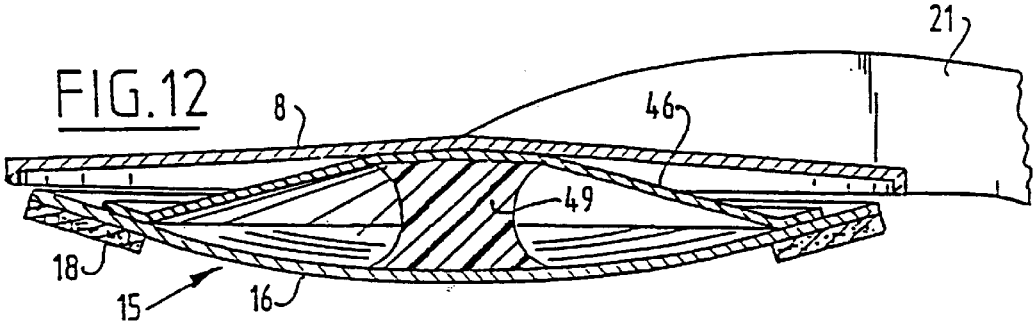

In FIG. 12 the centering of the plate 16 is realized almost solely by means of the membrane 46 which is glued between elastic rubber block 49 and cover 8 and glued to the plate 16. The membrane 46 and the plate 16 a gap therebetween as shown in FIG. 12. This is a simple and effective valve construction. The block 49 supports unglued against plate 16 such that plate 16 may swivel somewhat. Block 49 can have a half ball-shaped lower end or be constituted wholly by an elastic ball.

Figure 13:
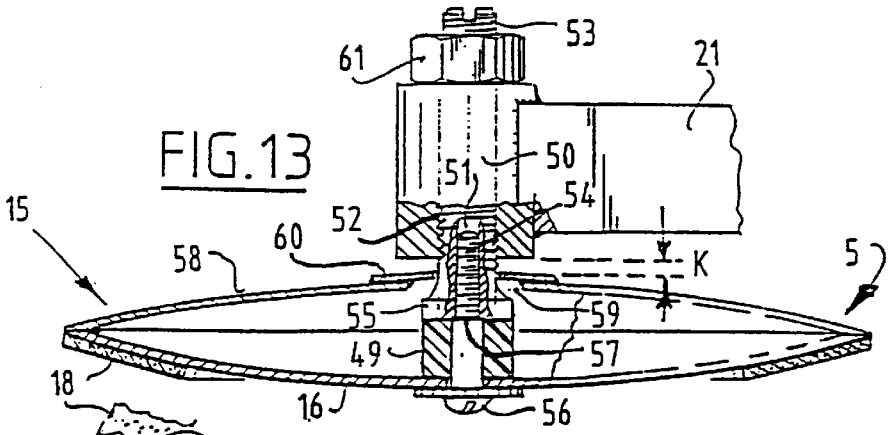
Figure 14:
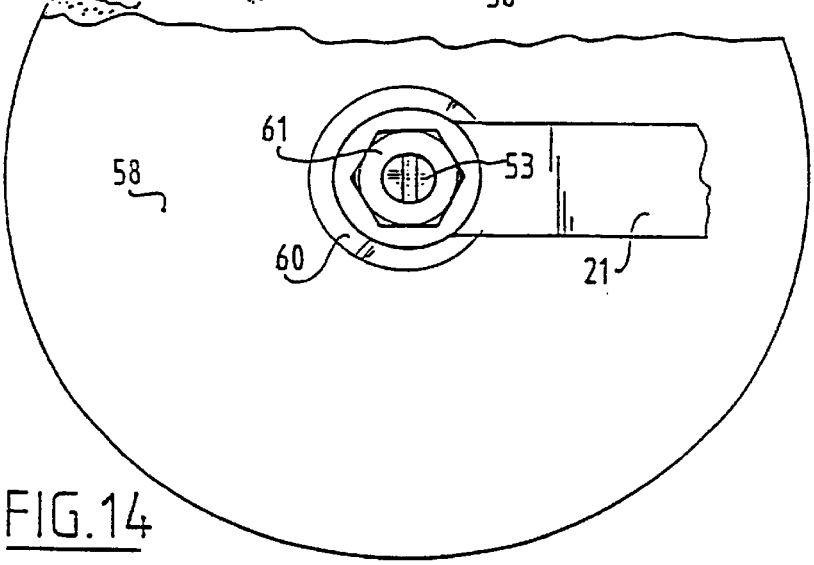
FIGS. 14 and 16 each show a fraction of the top view of FIG. 13 respectively 15.

The valve 15 of FIGS. 13 and 14 does not have the cover 8. A brass bush 50 is soldered to rod 21 and has a threaded hole 51 into which is screwed a screwed rod 52 with a grooved head 53 for a screwdriver and a lower piece 55 comprising a threaded hole 54. A stiff, concave or flat plate 16 of 0.4 mm brass is screwed into the threaded hole 54 by means of a screw 56 with a stop edge 57 with interposing of an elastic rubber block 49. Soldered to the plate 16 is an ornamental disc 58 of thin brass and a central opening 59 thereof is optionally covered with a soldered brass ring 60. A small play K of for instance 1 or 2 mm is left free between bush 50 and ring 60. Due to the yieldable means formed by the elastic rubber block this closure member 15 can yield slightly after closing of the valve 5 during a small continuing downward movement of bush 50. This closure member 15 is easily adjustable when the counter-nut 61 is released.

Figure 15:
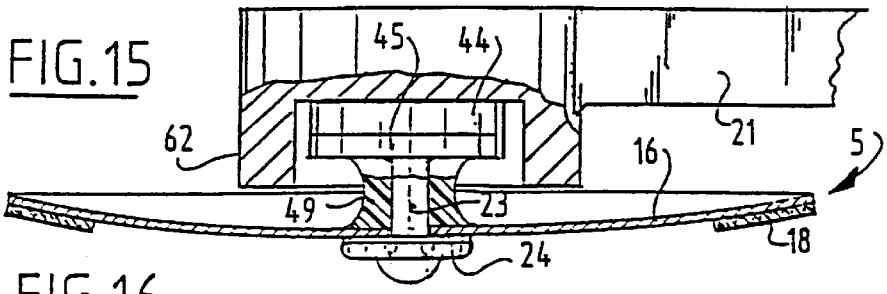
Figure 16:
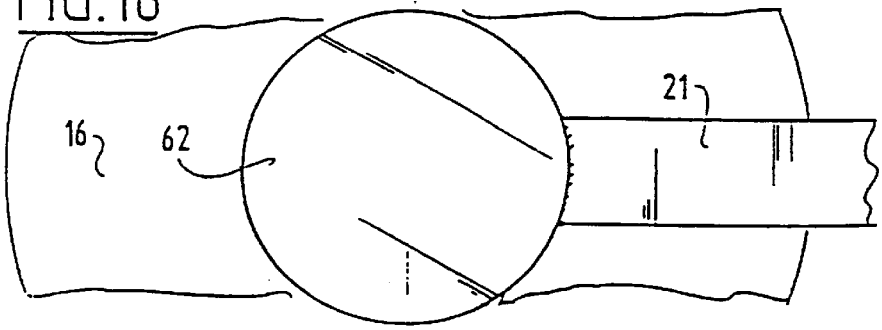

The valve 5 of FIGS. 15 and 16 has a brass bush 62 welded to a rod 21, in which bush a hard rubber base plate 45 is glued, optionally with interposing of a hard filling piece 44. A concave, stiff brass plate 16 encloses a rubber block 49 and is itself enclosed by a soft ring and a female part 24 of a press fastener.

In all figures the yieldable means 6, for instance consisting of a layer 22 or 32 or a block 49, allow a small stroke of the closure member 15 at a normal finger keying force during playing of the instrument such that the good sealing closure of each valve 5 of a plurality of simultaneously closing valves 5 is obtained when there is sufficient stiffness of the valve control. Too soft an elasticity is disastrous. While playing the instrument the musician must retain the feeling of a direct touch. The stroke permitted by the yieldable means 6 is preferably less than 3 mm and more preferably less than 1 mm. A stroke in the order of magnitude of 0.5 mm is ideal. The more a sensitive, or instance professional musician appreciates the perfect feeling of contact with the instrument the smaller the stroke is chosen, for instance 0.2–0.4 mm, since in such a case somewhat longer adjustment work and related higher costs are less important. However, the adjustment of a known instrument intended for professional use requires much more time.

In the case the, particularly professional, musician appreciates the absolute reliability of the perfect closure of the valves 5, he will prefer a slightly longer stroke, for instance 0.4–0.7 mm.

For amateurs who prefer preventing possible valve correction, a stroke in the order of magnitude of 1 mm and more is preferable.

Understood by the said finger force is a playing finger keying force, i.e. a kinetic energy corresponding with a static force lying between 0.25 and 5N, particularly between 0.25 and 3N and preferably smaller than 1N.

Figure 18:
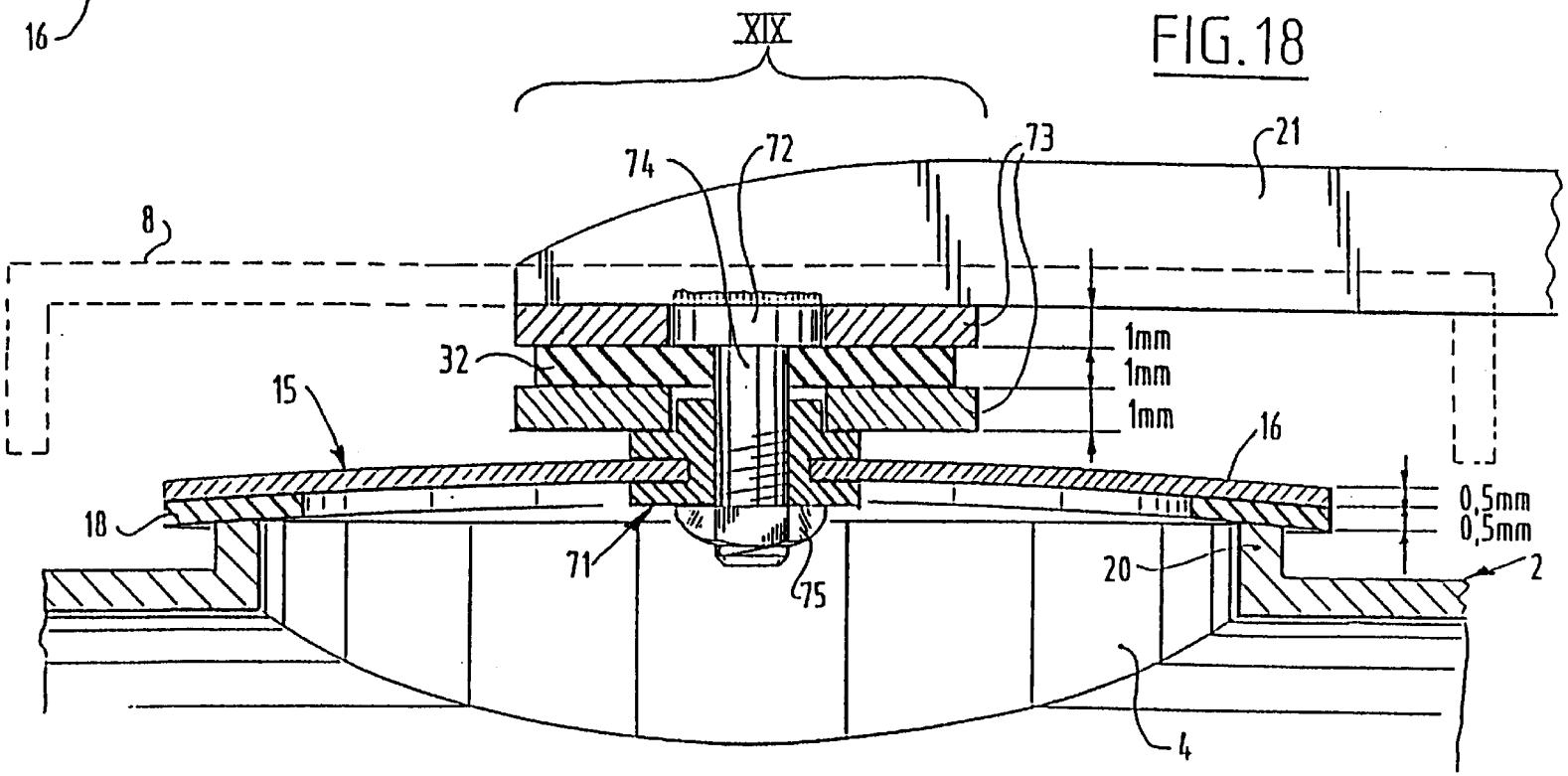

FIG. 18 shows on a scale of 6:1 a convex closure member 15 consisting of a metal, for instance tombac, stiff plate with a sealing ring 18 of cellular rubber, which closure member 15 adapts if necessary to the edge 20 by swiveling slightly in that it is received for slight swiveling in a solid rubber ring 71 with U-shaped profile and having a hardness between 40° and 80° Shore.

The valve holder 8, indicated with dashed lines, which is used in known wind instruments is omitted and to an arm 21 of the valve control mechanism is soldered a bolt head 72 and therearound a tombac ring 73. Around the bolt stem a ring of cellular rubber is arranged between two rings 73 which, together with the ring 71 and the closure member 15 contained therein, are clamped together by means of nut 75 screwed onto the bolt stem 74. The wind instrument of which all closure members 15, irrespective of their diameter, are practically all provided with identically dimensioned connecting means 71–75 and which have sealing rings 18 with a thickness of 0.5–1 mm and a width of ±3–8 mm, has a beautiful sound and requires hardly any adjustment after assembly. The sealing is ensured, the instrument plays smoothly, easily and clearly.

Figure 19:
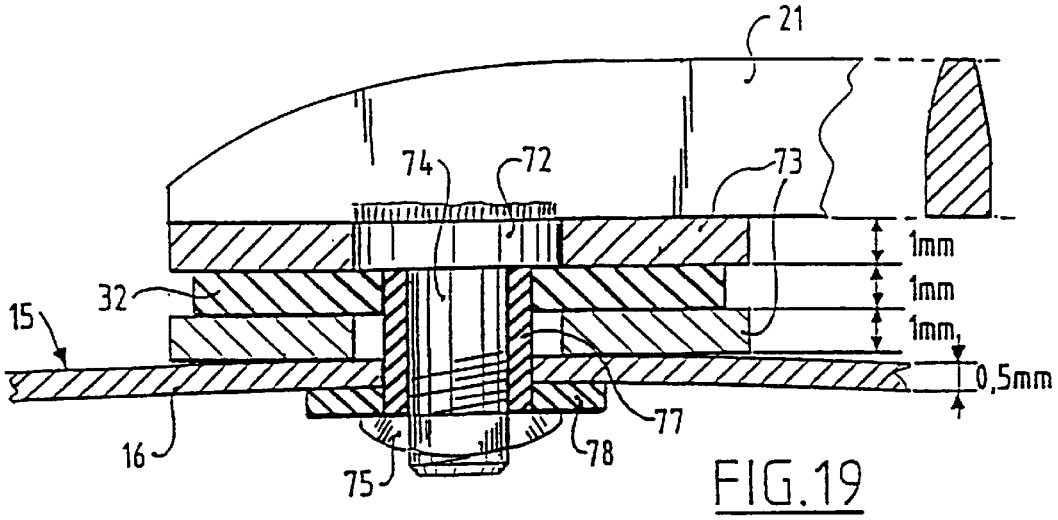

FIG. 19 is identical to FIG. 18, with the difference that a rubber hose 77 is arranged round the bolt stem 74 and the closure member 15 is further enclosed by means of a ring 78 of soft, practically solid rubber with a hardness in the order of magnitude of 0–50° Shore.

Figure 20:
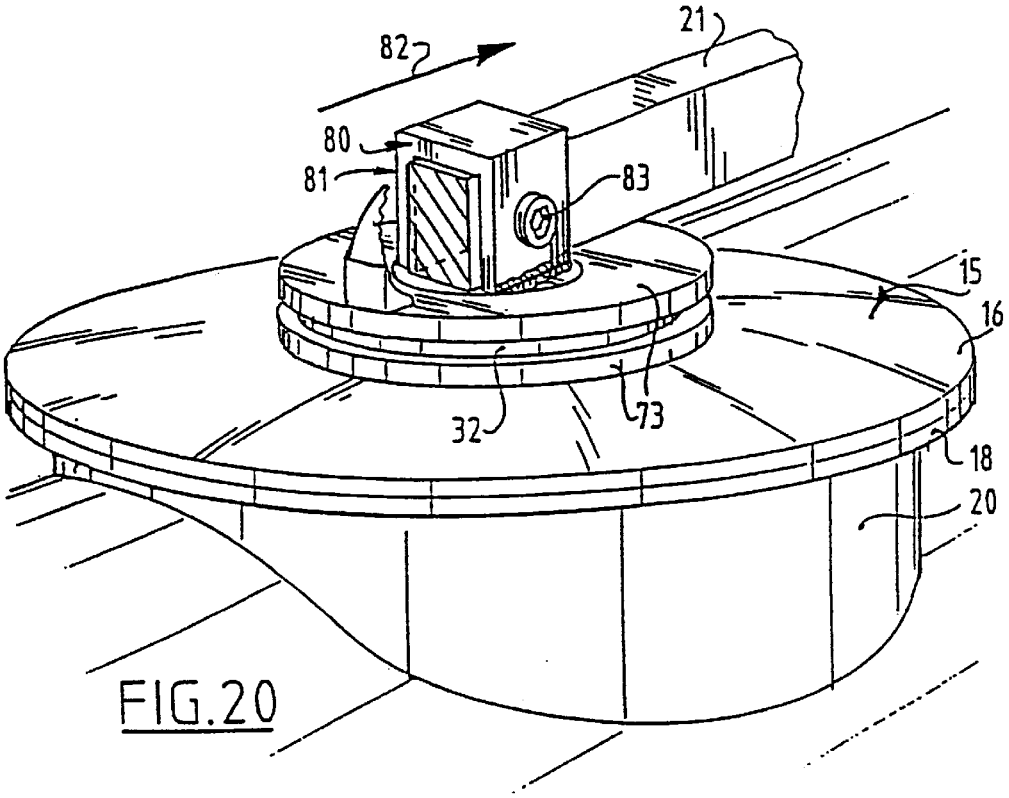
FIG. 20 is a perspective view of the embodiment shown in FIGS. 18 and 19.

According to FIG. 20 the closure member 15 is fixed to the arm 21 in that the bolt shaft 74 with bolt head 72 and ring 73 together with a U-shaped brace 80 form a mutually soldered unit 81, to which the closure member 15 according to FIGS. 18 and 19 is fixed. This unit 81 is placed on the arm 21 as according to arrow 82 and clamped thereon by means of screw 83.

Figure 21:
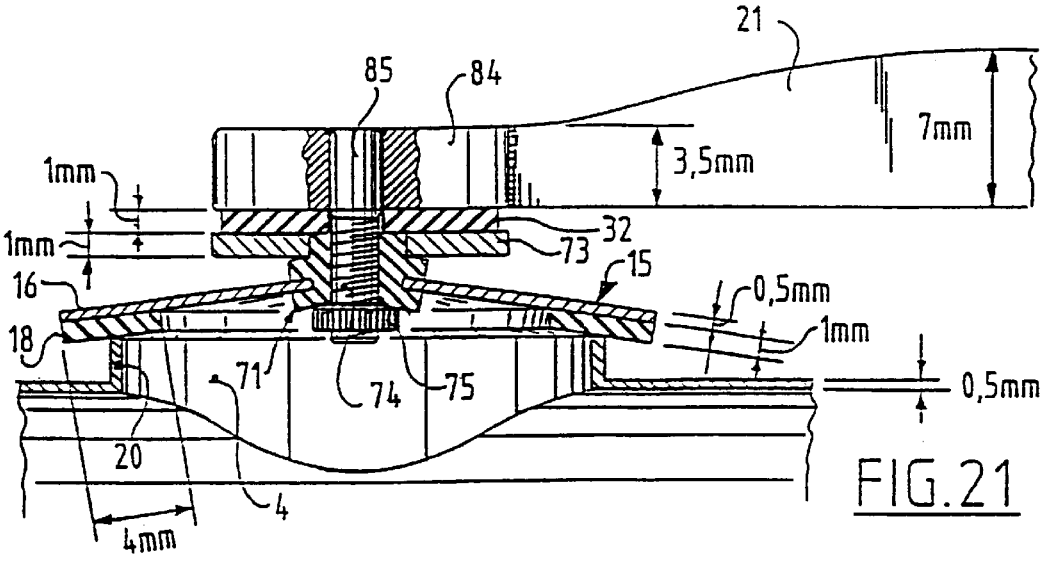
Figure 22:
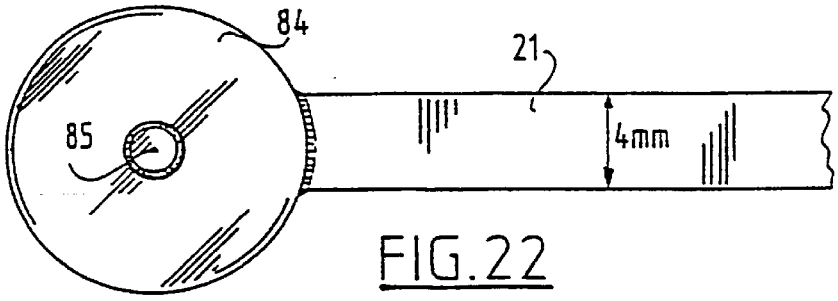
FIG. 22 shows a top view of the fraction of FIG. 21.

In FIGS. 21 and 22 the closure member 15 is fixed to a round disc-shaped end 84 of arm 21 by means of a nut 75, a practically solid rubber ring 71, a metal ring 73 and a cellular rubber ring 32 and by means of a bolt stream end 85 soldered in said end 84.

Figure 23:
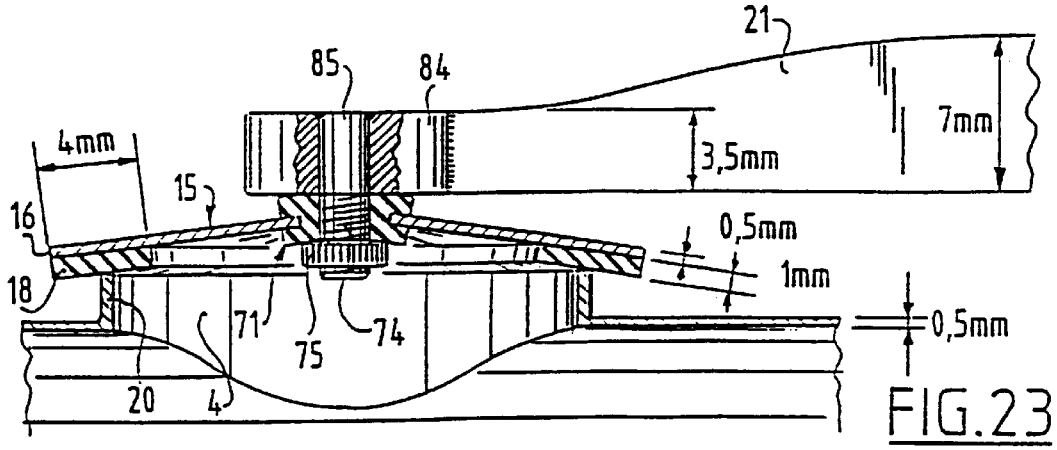

FIG. 23 is identical to FIG. 21, with the difference that the closure member 15 with its practically solid rubber ring of for instance 40° Shore is clamped directly against the disc 84. If the ring 71 fits closely round the bolt stem 74 the nut 75 may optionally be omitted.

In FIGS. 18–25 the components are shown with their preferred dimensioning. Reference is made to said indicated dimensions. Dimensions in the same order of magnitude are preferably applied. The diameters and the rings 18 of the various closure members 15 are of course adapted to the openings 4 of the basic body 2. Identical elements are otherwise used for the connections.

Because the closure members 15 seal so well, the valve springs of closed valves can be adjusted with less tension.

The edges 20 of the openings 4 are each properly ground flat in one and the same plane.

In FIGS. 24–28 a completely flat, thin metal plate 16, for instance of titanium with a thickness of for instance 0.2–0.5 mm, preferably of this order of magnitude, fits on the flat edge 20 with interposing of the thin sealing ring 18 of cellular rubber with closed cell structure of for instance a thickness of 0.5–2 mm, preferably of this order of magnitude. A plate 16 of plastic or other form-retaining, albeit elastic, material can also be envisaged. The plate 16 is adhered centrally to the rod 21 with interposing of yieldable means 22, which in FIG. 29 consist of a soft rubber core 92 (hardness 40–80° Shore) with a diameter of 2–7 mm and a height of 1–5 mm, which is surrounded by a ring 93 of cellular rubber with a diameter of 4–12 mm and a thickness of 1–5 mm. Ring 93 is glued on both sides between the plate 16 and a bush 94 which is soldered to a rod 21 without cover 8 or glued between the plate 16 and a cover 8 normally integrated with the rod 21. The ring 93 serves to increase the adhesion surface of the layers of glue 96 without preventing the required swivel possibility of plate 16. The core 92 is loosely enclosed between bush 94 (or cover 8) and plate 16 or is glued to only one side, and can be conical or have another shape, as shown in FIG. 29.

The plate 16 is preferably completely flat, but can however be permanently concave or convex under the influence of the closing force. The yieldable means 22 can also take the form of the elements 49 of FIG. 12, preferably having a thin middle portion.

All given dimensions and values serve as example and indication of the order of magnitude. The springs which tension the control means are adapted to the necessary compressions for closing the valves, i.e. tensioned considerably less than usual. The instrument according to the invention hereby plays very lightly. It is less tiring and it is possible to play faster and better. The tension of the springs of valves closed in rest position is preferably low such that as a result of hard blowing these valves are only just not blown open by the then occurring air pressure; the tension of the springs of valves opened in rest position is preferably low such that these valves move up and downward with just enough speed to follow the fingers during fast playing. The spring tensions are herein chosen slightly higher for safety reasons.

Figure 24:
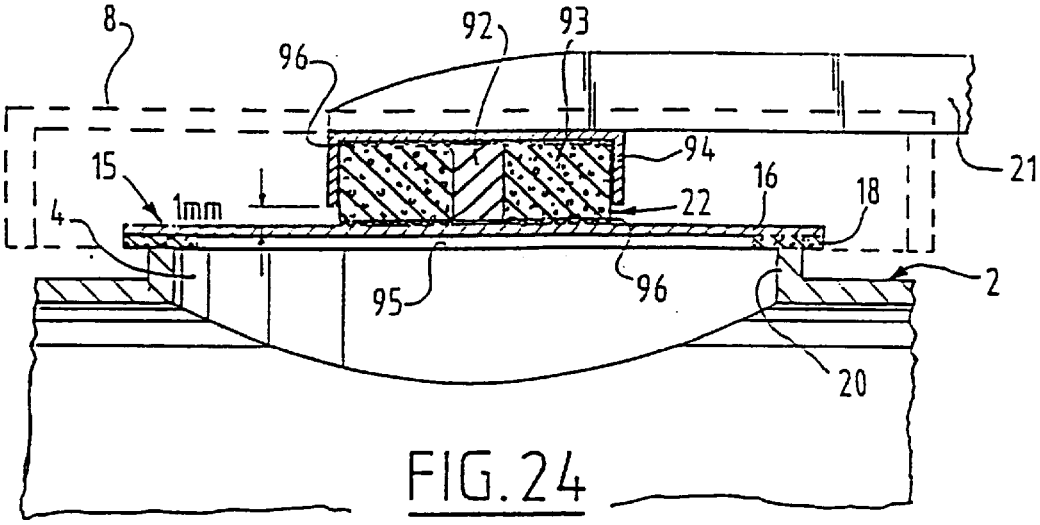
Figure 25:
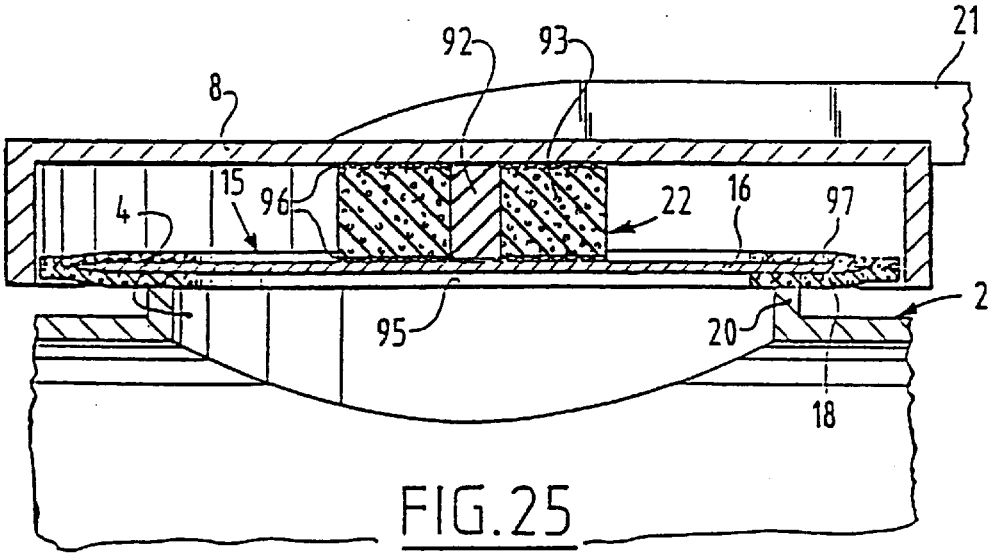

In FIG. 24 the displacement of the valve 15 in radial direction is prevented by the edge of the bush 94 which extends up to a small distance of for instance 1 mm from the plate 16.

In FIGS. 25–28 a guide ring 97 is glued on plate 16 and on the sealing ring 18 extending outward of plate 16. The guide ring 97 of elastic material, for instance foam plastic with a thickness of 0.7–2 mm, preferably 0.7–1.5 mm, is preferably a little stiffer than sealing ring 18 and substantially holds valve 18 in position in radial direction. The rotation of valve 15 is prevented as in the other figures by the ring 93 of soft cellular rubber which is glued on either side by means of a glue layer 96. The glue layer 96 cannot prevent swiveling of the core 92 or is absent at the core 92. A ball-shaped core 92 as according to FIG. 26 preferably enhances the swivel possibility of valve 15. The ball-shaped core 92 is for instance of solid rubber or teflon with hardness in the order of magnitude of 40 or 80° Shore at a diameter of 1.5–5 mm. The tough core ensures a good finger sensitivity requiring a small springing movement of the finger in the case of a force of ±0.25N during soft playing. At 2 to 2.5N in the case of fast and forte playing the springing displacement at the position of the finger keys should not be too great, (order of magnitude of 0.5–1.5 mm). The springing displacement is the sum of:

- 0–0.5 mm compression of the sealing ring 18 at a layer thickness of 0.8–1.25 mm of cellular rubber;
- 0–0.25 mm, bending of the plate 16 of stainless hardened steel with a thickness of 0.4 mm or titanium which may even be a little thinner, in any case a plate 16 with a stiffness in this order of magnitude;
- a small springing displacement of the core 92 in the order of magnitude of 0–0.75 mm;
- and a small springing displacement of the control system in the case of a plurality of mutually coupled valves.

The valve 15 can be supplied separately as mounting of repair valve, wherein the technician measures the internal height of the cover 8 if this is unknown to him and selects a ring 93 and a core 92 of roughly the same dimension r. The rings 93 are preferably provided on both sides with self-adhesive layers which are covered with removable pull-off strips.

Figure 26:
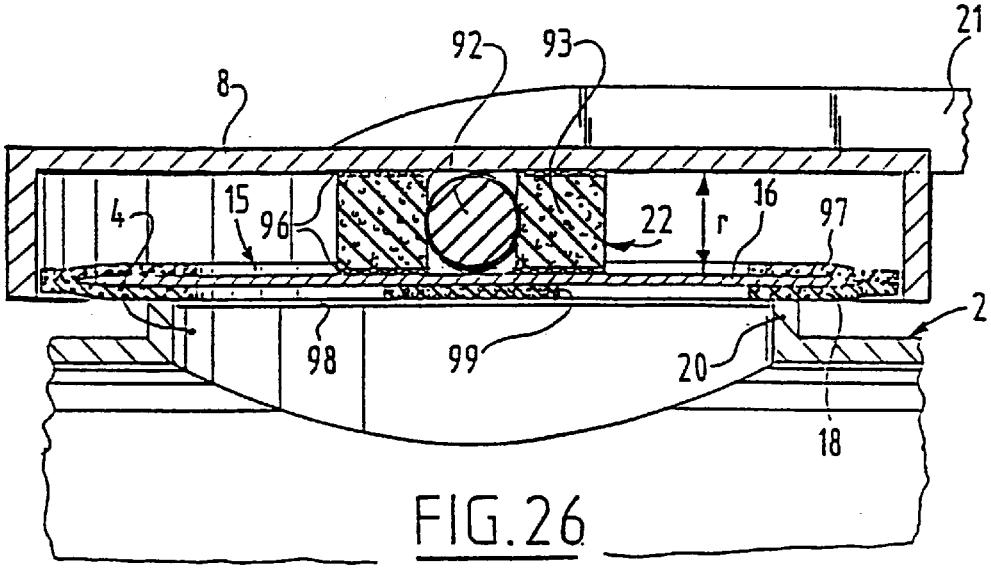
Figure 27:
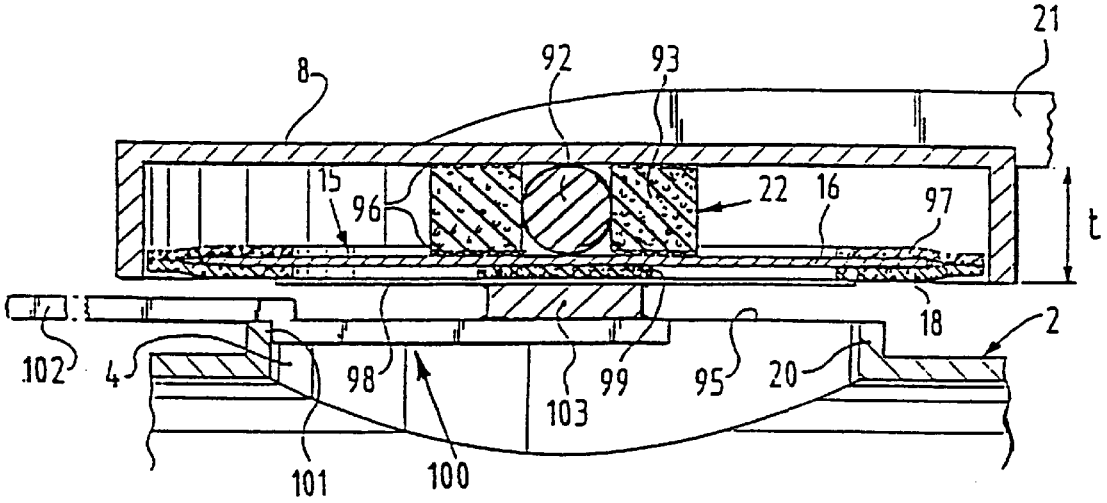

According to FIGS. 26 and 27 a thin resonance plate 98 is fixed centrally to plate 16 via a central thin layer 99 of cellular rubber or is directly glued onto sealing ring 18. The diameter of the resonance plate 98 is 2–4 mm smaller than the opening 4 and is for instance mounted as according to FIG. 27 by means of a spoon 100 which is held against the edge 20 with a stop 101 while said spoon is held by its handle 102. Glued to spoon 100 is a magnet 103 which attracts the steel resonance plate 98 having already glued thereon the layer 99 which carries an adhesive layer on the upper side. The resonance plate 98 is shifted over the magnet 103 to a centered position relative to opening 4, whereafter valve 15 is moved to opening 4 to be fixed to the resonance plate 98. The spoon with magnet is then removed.

The above mentioned sealing ring 18 of cellular rubber with closed cells can be used to additional advantage in a bass clarinet and like instruments to avoid the problem of "blowing bubbles".

Figure 17:
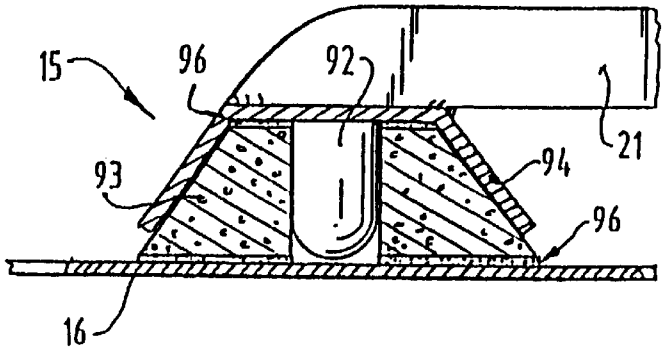

The valve 15 of FIG. 17 has a frustoconical ring 93 of cellular rubber glued to plate 16 and glued in bush 94 with frustoconical guide edge. Plate 16 can swivel on the rounded lower end of core 92 of solid rubber or teflon, each of 40°–80° Shore.

Figure 28:
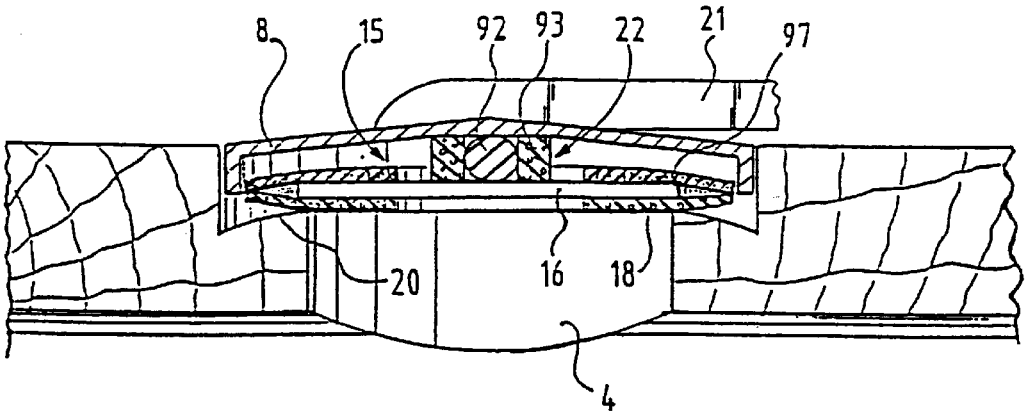
Figure 29:
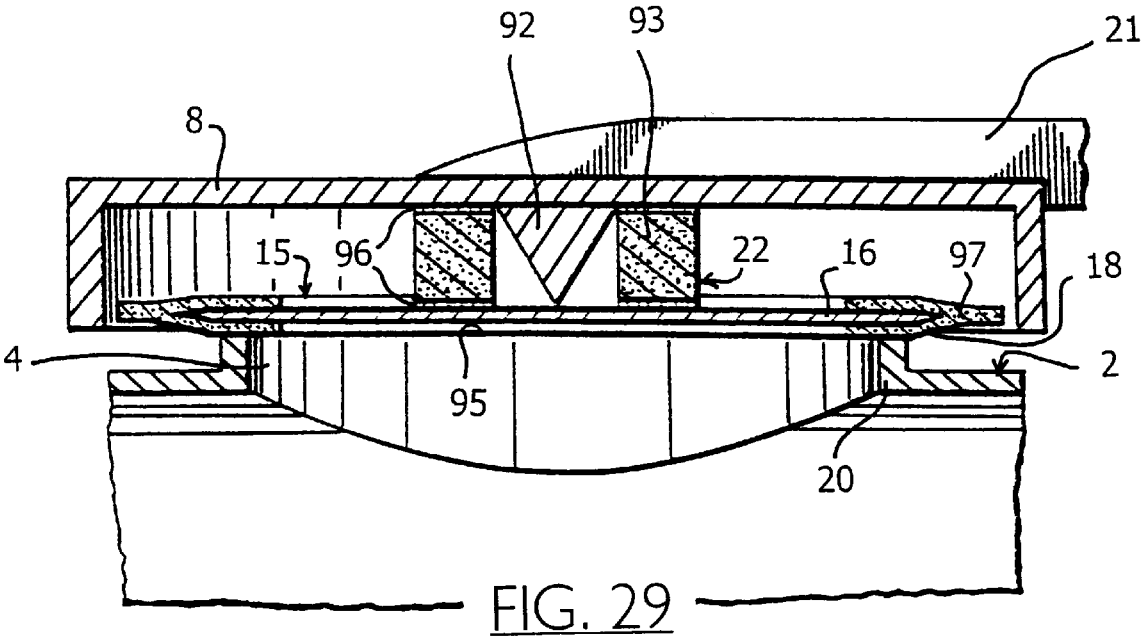
FIG. 29 is a sectional elevational view of another embodiment of the invention corresponding with FIG. 3.

FIG. 28 shows a detail of a wooden musical instrument, for instance a clarinet, of which the opening 4 is bounded by a concave valve seat edge 20. The valve 15 is constructed in principle as in FIG. 26.

In order to obtain the required flexibility of the tilting movement of plate 16, the diameter of the foam rubber rings 22 is between 4 and 15 mm, preferably between 5 and 13 mm and more preferably between 7 and 11 mm. The internal diameter of said bush 94 (if present) is slightly (±1 mm) greater than the outer diameter of ring 22.

The plates 16 are produced in flat condition by cutting them from flat plates by means of laser beams or by an etching operation in which metal material is removed at the cutting lines, for instance from both sides, during corrosion by means of an acid. According to known etching techniques the cutting lines are determined by light-sensitive films on one or both sides of the metal plates, which films are treated with light according to a predetermined pattern.

I claim:

1. A wind instrument, comprising:

a basic body, in which extends a central duct bounded by a peripheral wall of the basic body;

a plurality of openings in the peripheral wall which connect the duct with the surrounding air; and a plurality of valves mounted on the basic body and each comprising a closure member co-acting with one of the openings in the peripheral wall and comprising control means connected to said valves, wherein said control means guide said closure member for movement between a closed position in which the opening is closed by said closure member and an open position in which the opening is left clear, wherein the closure member comprises a plate having a stiffness which is provided on a side facing toward the opening with sealing material attached to said plate and in the closed position engaging around the opening and wherein said plate is connected to said control means by yieldable means, said yieldable means comprising a combination of at least one core made of elastic material for cushioning said plate relative to said control means and at least one connection member of flexible material at least partly surrounding said core and connected to said control means, said yieldable means positioned on a side of said plate opposite the side of said plate with the sealing material and facing said control means, wherein said connection member is more flexible than said core.

2. The wind instrument as claimed in claim 1, wherein said yieldable means provides axial displacement of the closure member relative to said control means when a keying force is applied to said yieldable means.

3. The wind instrument as claimed in claim 2, wherein the closure member is supported relative to the control means by a central elastic element surrounded by said support member including a ring of elastic material, which support member permits tilting of said closure member.

4. The wind instrument as claimed in claim 2, wherein the closure member is connected in its center to said control means.

5. The wind instrument as claimed in claim 1, wherein said connection member is a ring of elastic foam material surrounding said core and permitting tilting of said plate.

6. The wind instrument as claimed in claim 5, wherein the closure member is connected in its center to said control means.

7. The wind instrument as claimed in claim 1, wherein the closure member is connected in its center to said control means.

8. The wind instrument as claimed in claim 1, wherein the sealing material includes a thin layer of foam material.

9. A wind instrument, comprising:

a basic body, in which extends a central duct bounded by a peripheral wall of the basic body;

a plurality of openings in the peripheral wall which connect the duct with the surrounding air; and a plurality of valves mounted on the basic body and each comprising a closure member co-acting with one of the openings in the peripheral wall and comprising control means connected to said valves, wherein said control means guide said closure member for movement between a closed position in which the opening is closed by said closure member and an open position in which the opening is left clear, wherein the closure member comprises a plate having a stiffness which is provided on a side facing toward the opening with sealing material attached to said plate and in the closed position engaging around the opening and wherein said plate is connected to said control means by yieldable means, said yieldable means comprising a combination of at least one core made of elastic material for cushioning said plate relative to said control means and at least one ring of soft material bounding a radial displacement of said plate and connected to said control means, said ring at least partly surrounding said core and radially extending beyond the edge of said plate, wherein said control means comprises a disc covering said closure member, and wherein a radial displacement of the plate is bounded by a collar of said disc, said disc being connected to said control means, said collar facing toward the opening.

10. The wind instrument as claimed in claim 9, wherein said yieldable means provides axial displacement of said closure member relative to said control means when a keying force is applied to said yieldable means.

11. The wind instrument as claimed in claim 9, wherein the closure member is supported relative to the control means by a central elastic element surrounded by a support member including a ring of elastic material, which support member permits tilting of said closure member.

12. The wind instrument as claimed in claim 9, wherein the closure member is connected in its center to said control means.

13. The wind instrument as claimed in claim 9, wherein the sealing includes a thin layer of foam material.

14. A wind instrument, comprising:

a basic body, in which extends a central duct bounded by a peripheral wall of the basic body;

a plurality of openings in the peripheral wall which connects the duct with the surrounding air; and a plurality of valves mounted on the basic body and each comprising a closure member co-acting with one of the openings in the peripheral wall and comprising control means connected to said valves, wherein said control means guide said closure member for movement between a closed position in which the opening is closed by said closure member and an open position in which the opening is left clear, wherein said closure member comprises a plate having a stiffness which is provided on a side facing toward the opening with sealing material attached to said plate and in the closed position engaging around the opening and wherein said plate is connected to said control means by yieldable means, wherein said plate is connected to a rod of said control means by engagement means of stiff material comprising an engagement element, wherein said engagement means is fixedly mounted to said rod, and wherein said engagement means extends from a center of said plate in diverse directions over only a portion of the radius of said plate.

15. The wind instrument as claimed in claim 14, wherein said yieldable means provides axial displacement of said closure member relative to said control means when a keying force is applied to said yieldable means, said yieldable means comprising a combination of at least one core made of elastic material for cushioning said plate relative to said control means and at least one connection member of flexible material at least partly surrounding said core and connected to said control means, said yieldable means positioned on a side of said plate opposite the side of said plate with the sealing material and facing said control means.

16. The wind instrument as claimed in claim 14, wherein the closure member is supported relative to the control means by a central elastic element surrounded by said support member including a ring of elastic material, which support member permits tilting of said closure member.

17. The wind instrument as claimed in claim 14, wherein the closure member is connected in its center to said control means.

18. The wind instrument as claimed in claim 14, wherein said plate is made of titanium.

19. The wind instrument as claimed in claim 14, wherein said plate is made of stainless steel having a thickness between 0.15 and 0.8 mm.

20. A closure member for a wind instrument, comprising:

a plate of having a stiffness which is provided on a first side with sealing material attached to said plate for sealingly engaging around an opening of the wind instrument in a closed position; and a yieldable means secured to said plate on a second side of said plate opposite the first side of said plate with the sealing material, said yieldable means comprising a combination of at least one core made of elastic material for cushioning said plate and at least one connection member of flexible material at least partly surrounding said core.

21. The wind instrument as claimed in claim 20, wherein said yieldable means comprises a ring-shaped connection member of elastic foam material arranged on the second side of said plate.

22. The closure member as claimed in claim 21, wherein said ring-shaped connection member is arranged in a bush having an edge extending in a direction toward said plate, wherein said edge engages the outside of said ring-shaped connection member.

23. The closure member as claimed in claim 20, wherein said yieldable means comprises a flexible membrane having its peripheral edge adhered to the second side of said plate.

24. A wind instrument, comprising:

a basic body, in which extends a central duct bounded by a peripheral wall of the basic body;

a plurality of openings in the peripheral wall which connects the duct with the surrounding air; and a plurality of valves mounted on the basic body and each comprising a closure member co-acting with one of the openings in the peripheral wall and comprising control means connected to said valves, wherein said control means guide said closure member for movement between a closed position in which the opening is closed by said closure member and an open position in which the opening is left clear, wherein said closure member comprises a plate having a stiffness which is provided on a side facing toward the opening with sealing material attached to said plate and in the closed position engaging around the opening and wherein said plate is connected to said control means by yieldable means, said yieldable means comprising a combination of at least one core made of elastic material for cushioning said plate relative to said control means and at least one connection member of flexible material which is more flexible than the elastic material of the core connected to said control means, said yieldable means positioned on a side of said plate opposite the side of said plate with the sealing material and facing said control means.

25. A wind instrument, comprising:

a basic body, in which extends a central duct bounded by a peripheral wall of the basic body;

a plurality of openings in the peripheral wall which connects the duct with the surrounding air; and a plurality of valves mounted on the basic body and each comprising a closure member co-acting with one of the openings in the peripheral wall and comprising control means connected to said valves, wherein said control means guide said closure member for movement between a closed position in which the opening is closed by said closure member and an open position in which the opening is left clear, wherein said closure member comprises a plate without holes made of material having a stiffness which is provided on a side facing toward the opening with sealing material attached to said plate and in the closed position engaging around the opening and wherein said plate is connected to said control means by yieldable means, said yieldable means comprising a combination of at least one core made of elastic material for cushioning said plate relative to said control means and at least one connection member of flexible material at least partly surrounding said core and connected to said control means, said yieldable means positioned on a side of said plate opposite the side of said plate with the sealing material and facing said control means.

26. A wind instrument, comprising:

a basic body, in which extends a central duct bounded by a peripheral wall of the basic body;

a plurality of openings in the peripheral wall which connects the duct with the surrounding air; and a plurality of valves mounted on the basic body and each comprising a closure member co-acting with one of the openings in the peripheral wall and comprising control means connected to said valves, wherein said control means guide said closure member for movement between a closed position in which the opening is closed by said closure member and an open position in which the opening is left clear, wherein said closure member comprises a plate having a stiffness which is provided on a side facing toward the opening with sealing material attached to said plate and in the closed position engaging around the opening and wherein said plate is connected to said control means by yieldable means, said yieldable means comprising a combination of at least one core made of elastic material for cushioning said plate relative to said control means and at least one connection member of flexible material connected to said control means, said yieldable means positioned on a side of said plate opposite the side of said plate with the sealing material and facing said control means, said yieldable means being arranged between said control means and said plate and said connection member being adhered to said control means and to said plate.

27. A wind instrument, comprising:

a basic body, in which extends a central duct bounded by a peripheral wall of the basic body;

a plurality of openings in the peripheral wall which connects the duct with the surrounding air; and a plurality of valves mounted on the basic body and each comprising a closure member co-acting with one of the openings in the peripheral wall and comprising control means connected to said valves, wherein said control means guide said closure member for movement between a closed position in which the opening is closed by said closure member and an open position in which the opening is left clear, wherein said closure member comprises a plate without holes made of material having a stiffness which is provided on a side facing toward the opening with sealing material and in the closed position engaging around the opening and wherein said plate is connected to said control means by yieldable means, said yieldable means positioned on a side of said plate opposite the side of said plate with the sealing material and facing said control means, said yieldable means comprising at least two yieldable members positioned between said plate and said control means, the at least two yieldable members including a first yieldable member and a second yieldable member.

28. The wind instrument as claimed in claim 27, wherein said first yieldable member is a core positioned about the center of said plate and said second yieldable member is at least partly surrounding said core.

29. The wind instrument as claimed in claim 28, wherein said second yieldable member is annular-shaped and receives said first yieldable member therein.

30. The wind instrument as claimed in claim 28, wherein said second yieldable member is a membrane attached to said plate and to said control means, said second yieldable member includes a body with an outer edge attached to said plate.

31. The wind instrument as claimed in claim 30, wherein said second yieldable member defines a gap between said second yieldable member body and said plate.

32. The wind instrument as claimed in claim 27, wherein said first yieldable member and said second yieldable member are made of different materials.

33. The wind instrument as claimed in claim 32, wherein said different materials have differing hardness.

34. The wind instrument as claimed in claim 27, wherein said second yieldable member is adhesively secured to at least one of said plate and said control means and said first yieldable member is unadhered to said plate.

35. The wind instrument as claimed in claim 27, wherein said second yieldable member is made of a more flexible material than said first yieldable member.

36. A wind instrument, comprising:

a basic body, in which extends a central duct bounded by a peripheral wall of the basic body;

a plurality of openings in the peripheral wall which connects the duct with the surrounding air; and a plurality of valves mounted on the basic body and each comprising a closure member co-acting with one of the openings in the peripheral wall and comprising control means connected to said valves, wherein said control means guide said closure member for movement between a closed position in which the opening is closed by said closure member and an open position in which the opening is left clear, wherein said closure member comprises a plate having a stiffness which is provided on a side facing toward the opening with sealing material attached to said plate and in the closed position engaging around the opening and wherein said plate is connected to said control means by yieldable means, said yieldable means positioned on a side of said plate opposite the side of said plate with the sealing material and facing said control means, said yieldable means comprising at least two yieldable members positioned between said plate and said control means, the at least two yieldable members including a first yieldable member and a second yieldable member.

37. The wind instrument as claimed in claim 36, wherein said first yieldable member is a core positioned about the center of said plate and said second yieldable member is at least partly surrounding said core.

38. The wind instrument as claimed in claim 37, wherein said core is cone-shaped.

39. The wind instrument as claimed in claim 37, wherein said core is spherical-shaped.

40. The wind instrument as claimed in claim 37, wherein at least one of said first yieldable member and said second yieldable member is annular-shaped.

41. The wind instrument as claimed in claim 40, wherein said first yieldable member and said second yieldable member are annular-shaped and secured to said plate by a pin passing therethrough, wherein said second yieldable member is a hose received by said pin, and wherein said hose is positioned between said pin and said plate.

42. The wind instrument as claimed in claim 36, wherein said second yieldable member is a connection member and is adhesively secured to at least one of said plate and said control means and said first yieldable member is unadhered to said plate.

43. The wind instrument as claimed in claim 36, wherein said second yieldable member is made of a more flexible material than said first yieldable member.

44. The wind instrument as claimed in claim 36, wherein said first yieldable member and said second yieldable member are made of different materials.

45. The wind instrument as claimed in claim 44, wherein said different materials have differing hardness.

46. A closure member for a wind instrument, comprising:

a plate having a stiffness which is provided on a side of said plate facing toward an opening of the wind instrument with sealing material attached to said plate for sealingly engaging around the opening of the wind instrument, in a closed position; and a yieldable means secured to said plate on a side of said plate opposite the side of said plate with the sealing material, said yieldable means comprising a combination of at least one core made of elastic material for cushioning said plate and at least one connection member of flexible material, which is more flexible than the elastic material of said core.

47. A closure member for a wind instrument, comprising:

a plate having a stiffness which is provided on a side of said plate facing toward an opening of the wind instrument with sealing material attached to said plate for sealingly engaging around the opening of the wind instrument in a closed position; and a yieldable means secured to said plate on a side of said plate opposite the side of said plate with the sealing material, said yieldable means comprising a combination of at least one core made of elastic material for cushioning said plate and at least one connection member of flexible material, said yieldable means being adhered to said plate.

48. A closure member for a wind instrument, comprising:

a plate having a stiffness which is provided on a side of said plate facing toward an opening of the wind instrument with sealing material attached to said plate for sealingly engaging around said opening of the wind instrument in a closed position; and a yieldable means secured to said plate on a side of said plate opposite the side of said plate with the sealing material, said yieldable means comprising a combination of at least two yieldable members for cushioning said plate, the at least two yieldable members including a first yieldable member for cushioning said plate and a second yieldable member connecting said plate to said control means.

49. The closure member as claimed in claim 48, wherein said first yieldable member is a core positioned about the center of said plate and said second yieldable member is at least partly surrounding said core.

50. The closure member as claimed in claim 49, wherein said second yieldable member is annular-shaped and receives said first yieldable member therein.

51. The wind instrument as claimed in claim 49, wherein said core is spherical-shaped.

52. The closure member as claimed in claim 49, wherein said core is cone-shaped.

53. The closure member as claimed in claim 49, wherein said second yieldable member is a connection member attached to said plate and to said control means, said second yieldable member includes a body with an outer edge attached to said plate.

54. The closure member as claimed in claim 53, wherein said second yieldable member defines a gap between said second yieldable member body and said plate.

55. The closure member as claimed in claim 48, wherein said first yieldable member and said second yieldable member are made of different materials.

56. The closure member as claimed in claim 55, wherein said different materials have differing hardness.

57. The closure member as claimed in claim 48, wherein said second yieldable member is adhesively secured to at least one of said plate and said control means and said first yieldable member is unadhered to said plate.

58. The closure member as claimed in claim 48, wherein said second yieldable member is made of a more flexible material than said first yieldable member.

* * * * *

UNITED STATES PATENT AND TRADEMARK OFFICE

CERTIFICATE OF CORRECTION

PATENT NO. : 5,900,562

DATED : May 4, 1999

INVENTOR(S) : Rienk Smeding

It is certified that error appears in the above-identified patent and that said Letters Patent is hereby corrected as shown below:

In the Drawings, refer to FIG. 1, front opening "4" should read --4A-- and "1A" should read --1--.

Column 1 Line 12 after "connect" insert --the--.

Column 1 Line 15 "which is produce" should read --which is produced--.

Column 2 Line 4 "closure member" should read --closure members--.

Column 2 Line 14 "muffing" should read --muffling--.

Column 2 Line 27 "can effect" should read --can affect--.

Column 2 Line 34 after "member" delete --or--.

Column 2 Line 52 "FIG." should read --FIGS.--.

Column 2 Line 61 "FIG. 13 respectively 15" should read --FIGS. 13 and 15, respectively,--.

Column 3 Line 27 "to be describes" should read --to be described--.

Column 3 Line 53 after "thin layer" insert --of--.

Column 4 Line 8 "male part 123" should read --male part 23--.

Column 4 Line 33 "rod (21B" should read --rod 21B--.

Column 4 Line 44 "by means or" should read --by means of--.

UNITED STATES PATENT AND TRADEMARK OFFICE

CERTIFICATE OF CORRECTION

PATENT NO. : 5,900,562

DATED : May 4, 1999

INVENTOR(S) : Rienk Smeding

It is certified that error appears in the above-identified patent and that said Letters Patent is hereby corrected as shown below:

Column 5 Line 49 "membrane 46 first" should read --membrane 46 is first--.

Column 6 Line 11 "plate 16 a gap" should read --plate 16 define a gap--.

Column 7 Line 39 "bolt stream" should read --bolt stem--.

Column 8 Line 55 after "too great" delete comma --,--.

Column 9 Line 3 after "height" insert --t--.

Claim 11 Column 11 Line 5 after "surrounded by" delete "a" and insert --said--.

Claim 20 Column 11 Line 66 after "a plate" delete --of--.

Signed and Sealed this

Second Day of November, 1999

*Attest:*

*Attesting Officer*

Q. TODD DICKINSON

*Acting Commissioner of Patents and Trademarks*